US007823427B2

(12) United States Patent
Katagiri

(10) Patent No.: US 7,823,427 B2
(45) Date of Patent: Nov. 2, 2010

(54) CYLINDER LOCK DEVICE

(75) Inventor: Toshiharu Katagiri, Aichi (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 387 days.

(21) Appl. No.: 12/098,752

(22) Filed: Apr. 7, 2008

(65) Prior Publication Data

US 2008/0245119 A1 Oct. 9, 2008

(30) Foreign Application Priority Data

Apr. 6, 2007 (JP) ..... 2007-101167

(51) Int. Cl.
*E05B 17/04* (2006.01)

(52) U.S. Cl. ..... 70/379 R; 70/380; 70/422; 70/492

(58) Field of Classification Search ..... 70/379 R, 70/380, 373, 377, 422, 492, 495, 496
See application file for complete search history.

(56) References Cited

U.S. PATENT DOCUMENTS 5,265,453 A * 11/1993 Konii et al. ..... 70/379 R
5,577,409 A 11/1996 Oyabu et al.
6,711,924 B2 * 3/2004 Ritz ..... 70/422
7,472,570 B2 * 1/2009 Yamaguchi et al. ..... 70/379 R
2009/0038351 A1 * 2/2009 Tamezane et al. ..... 70/182
2010/0132420 A1 * 6/2010 Flandrinck ..... 70/380

FOREIGN PATENT DOCUMENTS

JP 8-4378 1/1996

* cited by examiner

*Primary Examiner*—Suzanne D Barrett
(74) *Attorney, Agent, or Firm*—Scully, Scott, Murphy & Presser, P.C.

(57) ABSTRACT

A cylinder lock device is provided with a rotor 30 arranged to be rotatable inside a body A20, a sleeve A40 arranged to be rotatable between the body A20 and the rotor 30, a sleeve B45, a tumbler 50 disengaged with the sleeve A40 or B45 when a regular key is inserted into a key insert hole 31, a lever member 60, a slide bar A70 which moves in an axial direction each time the sleeve A40 rotates relatively at a predetermined angle to the body A20, a body A25 in cylindrical shape arranged between the body A20 and the rotor 30, a solenoid 200 which makes a body B25 rotatably movable or unrotatable to the body A20, a slide bar B75 which moves in the axial direction each time the sleeve B45 rotates relatively to the body B25 at a predetermined angle, and a clutch member 80 to engage or disengage with the rotor 30.

20 Claims, 8 Drawing Sheets

CYLINDER LOCK DEVICE

The present application is based on Japanese Patent Application No. 2007-101167 filed on Apr. 6, 2007, the entire contents of which are incorporated herein by reference.

BACKGROUND OF THE INVENTION

1. Field of the Invention

The present invention relates to a cylinder lock device, in more particular, to a cylinder lock device in which functions are changed in accordance with a master key and a valet key.

2. Related Art

There are vehicle families which provide two kinds of key, one of which is a master key used by a driver for driving and another is a valet key. The valet key is used, for example, for depositing a vehicle by passing a key to a valet parking attendant of a hotel and entrusting him to move the vehicle to the parking etc. Both of the master key or the valet key can be used for locking or unlocking doors of the vehicle and start up an engine. Furthermore, it is possible to lock or unlock a trunk or a glove box with the master key, but not with the valet key.

Meanwhile, as a cylinder lock device used for the doors or the like of the vehicle, a cylinder lock device having a rotor arranged to be rotatable inside a body A in cylindrical shape and formed such that a key hole extends in an axial direction, has been known (for example, disclosed by JP-A-8-004378). In the cylinder lock device, a plurality of tumblers are provided in the rotor to be movable in a radial direction, and each tumbler is biased toward an outer radial direction and engaged with a sleeve. When a key is inserted into an insert hole, each tumbler is moved by a groove of the key. When a regular key is inserted, the engagement of each tumbler with the sleeve is released, so that the rotor and the sleeve are separated from each other to be rotatable. By rotating the key, a lever member is rotated together with the rotor to conduct the locking or unlocking operation.

However, in the conventional cylinder lock device disclosed by JP-A-8-004378, there is a problem in that it is not possible to change a function or an operation of the cylinder lock device in accordance with the master key or the valet key respectively.

THE SUMMARY OF THE INVENTION

Therefore, it is an object of the invention to provide a cylinder lock device by which it is possible to change the functions in accordance with the master key and the valet key.

According to the present invention, a cylinder lock device comprises:

a first body in cylindrical shape;

a rotor arranged to be rotatable inside the first body including a key insert hole to which a key is inserted, the key insert hole being formed to extend in an axial direction;

a first sleeve arranged to be rotatable between the first body and the rotor;

a second sleeve arranged to be rotatable between the first body and the rotor, and disposed more distant than the key insert hole;

a tumbler provided in the rotor to be movable in a radial direction to engage with the first sleeve or the second sleeve when biased to an outer radial direction and disengage with the first sleeve or the second sleeve when a regular key is inserted into the key insert hole;

a lever member arranged to be rotatable and facing to a key insert hole side in the rotor, for locking or unlocking a vehicle;

a first slide member arranged between the first sleeve and the first body, for moving in an axial direction toward the lever member each time the first sleeve rotates relatively to the first body at a predetermined angle;

a second body in a cylindrical shape arranged between the first and second sleeve, a lock part for making the second body rotatably movable or immovable with respect to the first body;

a second slide member arranged between the second sleeve and the second body, the second slide member moving in the axial direction toward the lever member each time the second sleeve rotates relatively to the second body at a predetermined angle;

a clutch member arranged between the rotor and the lever member to be movable in the axial direction in the lever member, and allowed to engage or disengage with the rotor; and a biasing member to bias the clutch member toward the rotor to be engaged with the rotor.

Preferably, the clutch member transmits a rotation of the rotor to the lever member when the key is a regular key in a state that the second body is made unrotatable by the lock part, and when the key is the regular key or a valet key in the state that the second body is made rotatable by the lock part.

Preferably, the valet key is provided with a different shape from the regular key in a part of a key tooth.

Preferably, each of the regular key and the valet key is provided with a key tooth shape corresponding to a first region, a second region or a third region of the tumbler, and the key tooth shape of the valet key is same as that of the regular key in the first region but the third region of the valet key is different from the second region of the regular key.

Preferably, the first sleeve is provided with an engaging groove to be engaged with an edge of the outer radial direction of the tumblers corresponding to the first region.

Preferably, the second sleeve is provided with an engaging groove engaged with an edge of the outer radial direction of the one tumbler corresponding to the second or third region is formed in the second sleeve.

Preferably, the first sleeve or the second sleeve rotates integrally with the rotor by engaging with each tumbler biased toward the outer radial direction.

Preferably, the first sleeve is in a substantially cylindrical shape, and provided with a pair of engaging grooves extending to the axial direction at a side thereof and a receiving groove for receiving the first slide member to be movable in the axial direction at the side thereof.

Preferably, the first slide member is formed in a substantially T-shape, received in the receiving groove of the first sleeve, and provided with an axial direction extending portion extending in the axial direction, and a circumferential direction extending portion extending in a circumferential direction at an edge of a clutch member side of the axial direction extending portion.

Preferably, the second sleeve is in a substantially cylindrical shape, and provided with a pair of engaging grooves extending to the axial direction at a side thereof and a receiving groove for receiving the second slide member to be movable in the axial direction at a side thereof.

Preferably, the second slide member is formed in a substantially T-shape, received in the receiving groove of the second sleeve, and has an axial direction extending portion extending in an axial direction and a circumferential direction extending portion extending in a circumferential direction at an edge of a clutch member side of the axial direction extending portion.

Preferably, the first body is formed in a step-like shape so that an inner diameter varies inside, and an end surface opposite to the circumferential direction extending portion in the axial direction extending portion of the first slide member slidably contacts to a step-like shaped sliding surface portion of the first body.

Preferably, the first body has a concave portion formed at a predetermined position on the sliding surface portion extending in the circumferential direction and both edges in the circumferential direction of the concave portion are inclined.

Preferably, both edges in the circumferential direction of the end surface of the first slide member are inclined.

Preferably, the second body has a step-like shaped sliding surface portion which slidably contacts to an end surface opposite to the circumferential direction extending portion in the axial direction extending portion of the second slide member.

Preferably, the second body has a concave portion formed at a predetermined position on the sliding surface portion extending in the circumferential direction and both edges in the circumferential direction of the concave portion are inclined.

Preferably, both edges in the circumferential direction of the end surface of the second slide member are inclined.

Preferably, the biasing member is a coil spring.

Preferably, the lock part is a solenoid installed in a periphery of the first body corresponding to a position of the second body.

Preferably, the solenoid makes the second body unrotatable with respect to the first body by a plunger of the solenoid which moves in a through hole of the first body and engages with a lock hole formed in the second body, and makes the second body rotatable with respect to the first body by the plunger which moves in the through hole of the first body and shunts toward the solenoid.

Effect of the Invention

According to present invention, it is possible to provide the cylinder lock device by which it is possible to change the functions in accordance with the master key and the valet key.

BRIEF DESCRIPTION OF THE DRAWINGS

Next, the present invention will be explained in more detail in conjunction with appended drawings, wherein:

FIG. 3A and 3B are plan views showing a shape of the key to be inserted in the key insert hole 31 of a rotor 30, wherein FIG. 3A shows the regular key and FIG. 3B shows a valet key;

FIG. 7 is a cross sectional view (along A-A line in FIG. 1) of the cylinder lock device in the state that the valet key is inserted in the key insert hole of the cylinder lock device when the valet system is ON.

DESCRIPTION OF THE PREFERRED EMBODIMENTS

Structure of a Cylinder Lock Device in the First Preferred Embodiment

Figure 1:
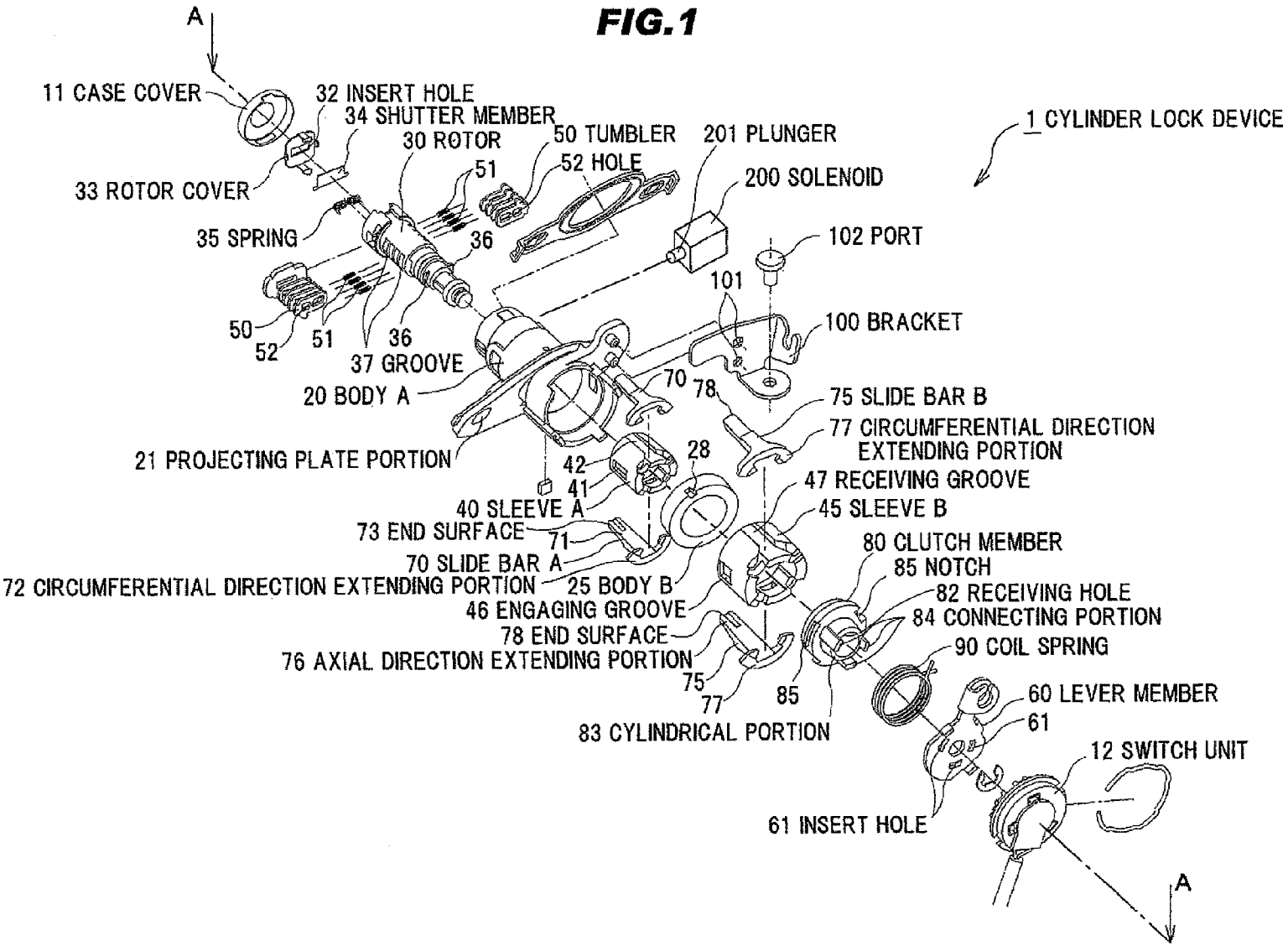
FIG. 1 is an exploded perspective view of a cylinder lock device in a first embodiment according to the present invention.
Figure 2:
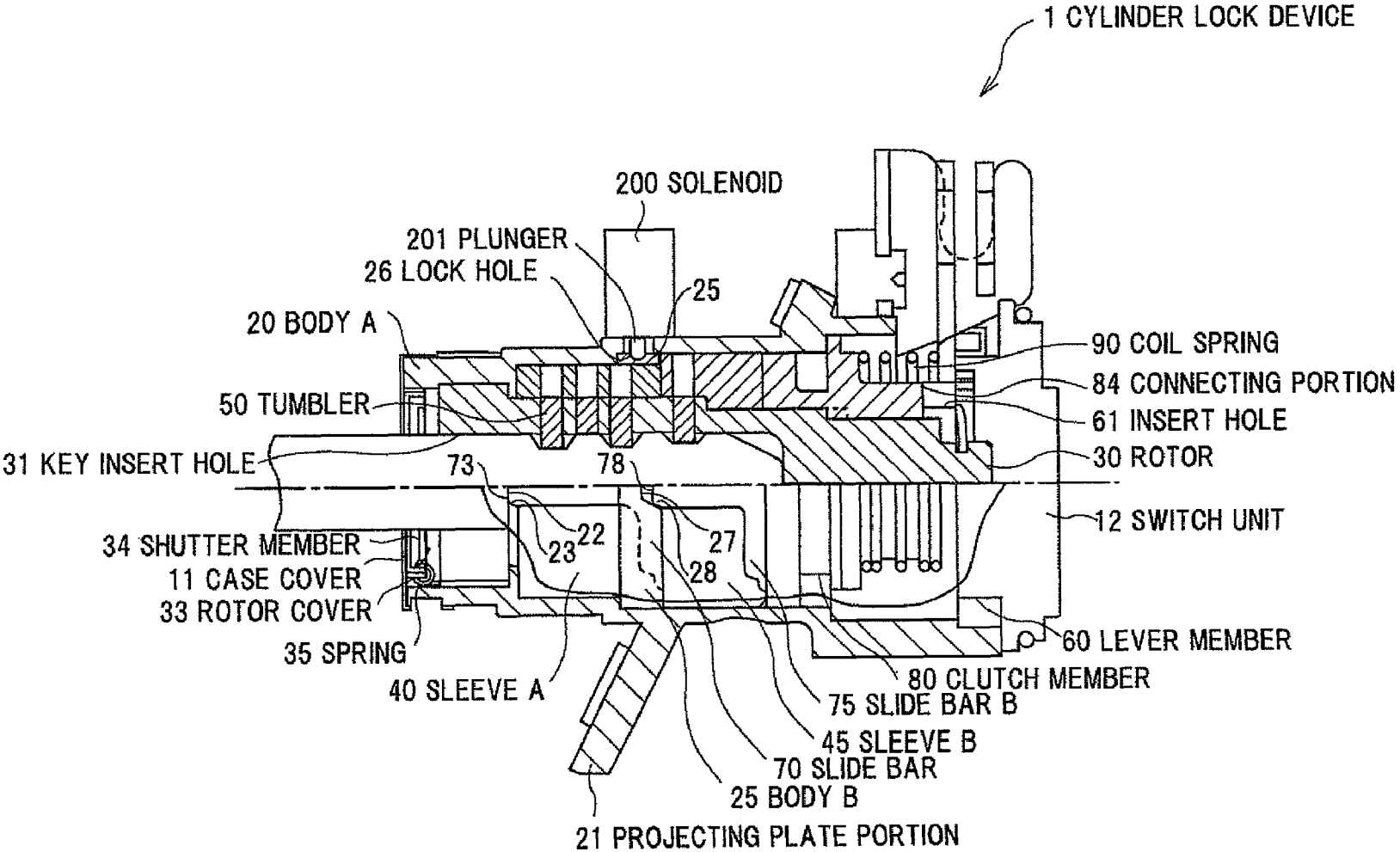
FIG. 2 is a cross sectional view (along A-A line in FIG. 1) of the cylinder lock device in the state that a regular key is inserted in a key insert hole of the cylinder lock device.

FIG. 1 is an exploded perspective view of a cylinder lock device in a first embodiment according to the present invention. FIG. 2 is a cross sectional view (along A-A line in FIG. 1) of the cylinder lock device in the state that a regular key is inserted in a key insert hole of the cylinder lock device. However, in FIG. 2, only the cross section of a body A is shown within a break line at a lower cross section and cross sections of a sleeve, a slide bar or the like are not shown. Furthermore, in each cross sectional view, a hatching is appropriately omitted for explanation (the same hereinafter).

A cylinder lock device 1 in the first preferred embodiment according to the present invention comprises a body A20 as a first body, a rotor 30 arranged to be rotatable inside the body A20 including a key insert hole 31 to which a key is inserted, the key insert hole 31 being formed to extend in an axial direction, a sleeve A40 as a first sleeve arranged to be rotatable between the body A20 and the rotor 30, a sleeve B45 as a second sleeve arranged to be rotatable between the first body and the rotor, and disposed more distant than the key insert hole 31, a tumbler 50 provided in the rotor 30 to be movable in a radial direction to engage with the sleeve A40 or the sleeve B45 when biased to an outer radial direction and disengage with the sleeve A40 or the sleeve B45 when a regular key is inserted into the key insert hole 31, a lever member 60 arranged to be rotatable and facing to a key insert hole side in the rotor 30, for locking or unlocking a vehicle, a slide bar A70 as a first slide member arranged between the sleeve A40 and the body A20, for moving in an axial direction toward the lever member 60 each time the sleeve A40 rotates relatively to the body A20 at a predetermined angle, a body B25 as a second body in a cylindrical shape arranged between the body A20 and the rotor 30, a solenoid 200 as a lock part for making the body B25 rotatably movable or immovable with respect to the body A20, a slide bar B75 as a second slide member arranged between the sleeve B45 and the body B25, the slide bar B75 moving in the axial direction toward the lever member 60 each time the sleeve B45 rotates relatively to the body B25 at a predetermined angle, a clutch member 80 arranged between the rotor 30 and the lever member 60 to be movable in the axial direction in the lever member 60, and allowed to engage or disengage with the rotor 30, and a coil spring 90 as a biasing member to bias the clutch member 80 toward the rotor 30 to be engaged with the rotor 30.

An edge of key insert hole side of the body A is covered with a case cover 11 and an edge opposite to the key insert side is covered with a switch unit 12. In the cylinder lock device 1, if the key is rotated in the state that the regular key is inserted in the rotor 30, the lever member 60 rotates together with the rotor 30. Here, the cylinder lock device 1 is provided with a clutch mechanism to idle the rotor 30 with respect to the clutch member 80 by releasing the engagement of the rotor 30 and the clutch member 80 when the rotor 30 is rotated with a force by an unauthorized key or a screwdriver, namely, a so-called freewheel system is adopted.

As shown in FIG. 1, a projecting plate portion 21 in which a plate surface is oriented toward the axial direction is formed on an outer periphery of the body A20. In this projecting plate portion 21, a projection to be inserted into an insert hole 101 formed on a bracket 100 for fixing is formed. The bracket 100 is fixed to the vehicle by a bolt 102 and the body A20 is fixed to the vehicle through the bracket 100.

The rotor 30 is in a substantially cylindrical shape and, as shown in FIG. 2, formed such that the key insert hole 31 extends in the axial direction. As shown in FIG. 1, the key insert side of the rotor 30 is covered with a rotor cover 33 in which a key insert hole 32 is formed at its center. A shutter member 34 to cover the key insert hole 32 is provided on the back side of this rotor cover 33 in the state that the key is not inserted. The shutter member 34 is biased in a direction to block off the key insert hole 32 by a spring 35 for shuttering.

Figure 4:
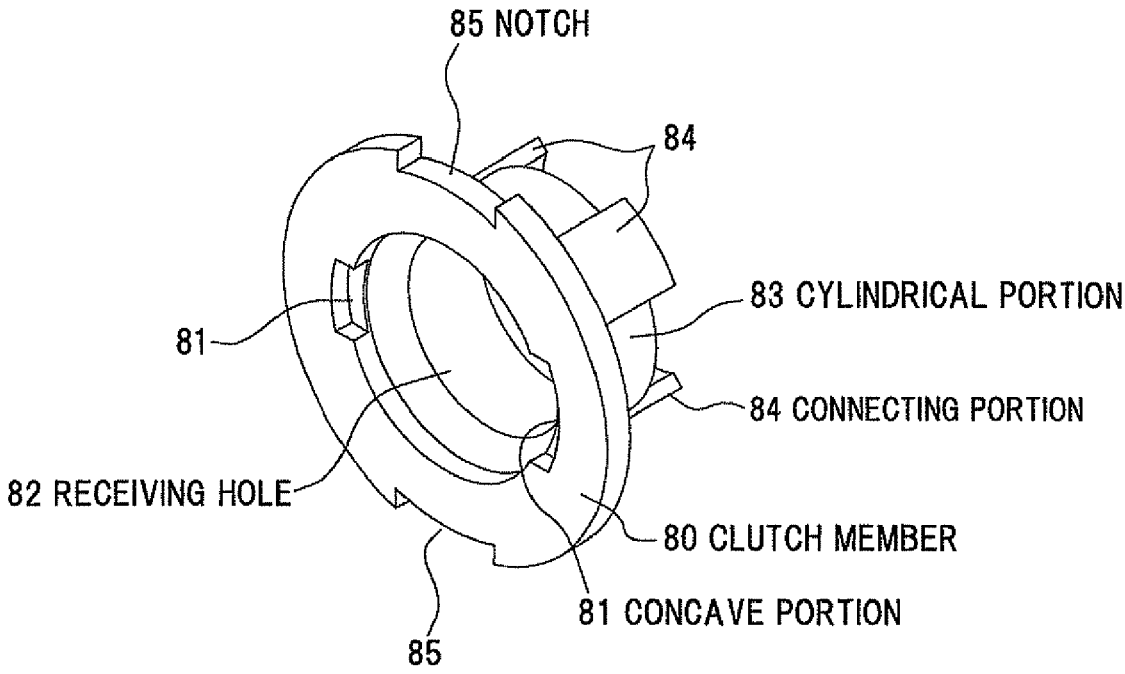
FIG. 4 is an outline perspective view of a clutch member 80.

Furthermore, as shown in FIG. 1, convex portions 36 that are engageable with a concave portion 81 of the clutch member 80 (see FIG. 4 described later) is formed on an outer periphery surface opposite to the key insert side in the rotor 30. Two convex portions 36 extending in a circumferential direction are formed at an interval of substantially 180°. Furthermore, as shown in FIG. 1, a groove 37 to guide the tumbler 50 in a radial direction is formed in the rotor 30. In this preferred embodiment, eight tumblers 50, four in each side, are arranged alternately and eight grooves 37 are formed. A key shape is configured to correspond to these eight grooves 37. The operation in the combination of the tumblers 50 at one side and the key shape will be explained.

Each tumbler 50 is biased in the outer circumferential direction by a spring 51 for a tumbler housed in each groove 37 respectively.

Figure 3A:
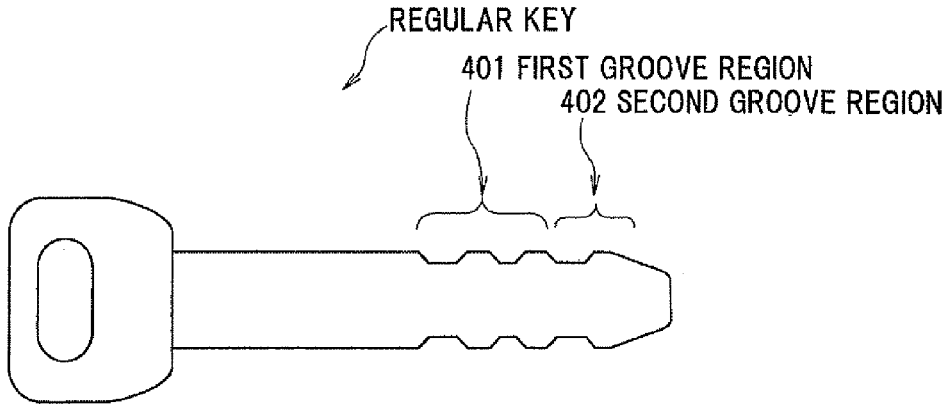
Figure 3B:
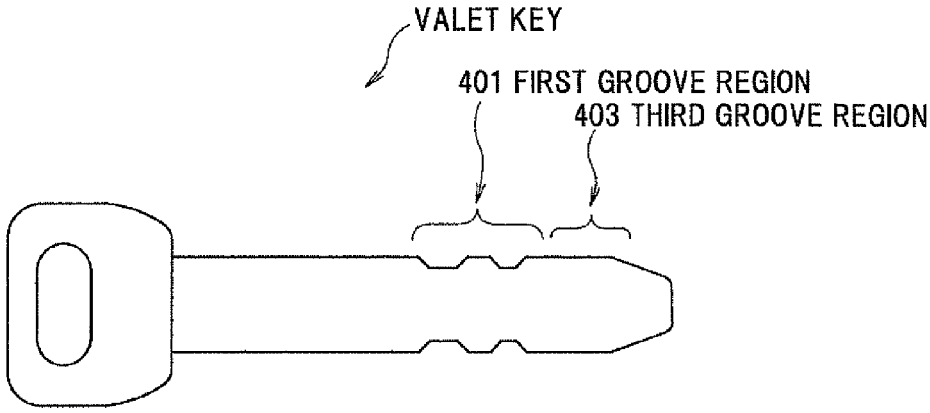

FIGS. 3A and 31B are plan views showing a shape of the key to be inserted in the key insert hole 31 of a rotor 30, wherein FIG. 3A shows the regular key and FIG. 3B shows a valet key. The valet key is provided with a different shape from the regular key in a part of a key tooth. In this preferred embodiment, a first groove region 401 in FIG. 3A and a first groove region 401 in FIG. 3B have a same key shape, but a second groove region 402 in FIG. 3A is different from a third groove region 403 in FIG. 3B. Then, the first groove region 401 in FIG. 3A and the first groove region 401 in FIG. 3B correspond to three tumblers 50 and the second groove region 402 in FIG. 3A and the third groove region 403 in FIG. 3B correspond to one tumbler 50. In this regard, keys other than the regular key (including so-called spare keys) and the valet key have different shapes and are called unauthorized key.

An engaging groove 41 to be engaged with an edge of the outer radial direction of the three tumblers 50 corresponding to the above-mentioned first groove region 401 is formed in the sleeve A40. Furthermore, an engaging groove 46 to be engaged with an edge of the outer radial direction of the one tumbler 50 corresponding to the second groove region 402 or the third groove region 403 is formed in the sleeve B45.

By engaging with each tumbler 50 biased to the outer radial direction, the rotor 30 and the sleeve A40 or the sleeve B45 rotate integrally.

A hole 52 corresponding to the regular key is formed in each tumbler 50 and each tumbler 50 moves in the radial direction in accordance with a groove shape of the key inserted to the rotor 30. When the regular key is inserted, all tumblers 50 are separated from the sleeve A40 and the sleeve B45 and the engagement is released, as a result, the rotor 30 and the sleeve A40, and the rotor 30 and the sleeve B45 are relatively rotatable to each other.

Meanwhile, when the valet key is inserted in the insert hole 31, three tumblers 50 corresponding to the first groove region 401 in FIG. 3B are separated from the sleeve A40 and the engagement is released, as a result, the rotor 30 and sleeve A40 are relatively rotatable to each other. However, since the tumblers 50 corresponding to the third groove region 403 in FIG. 3B are not separated from the sleeve B45 and the engagement is not released, the rotor 30 and sleeve B45 are not relatively rotatable to each other and they rotate integrally.

As shown in FIG. 1, the sleeve A40 is in a substantially cylindrical shape and a pair of engaging grooves 41 extending in the axial direction are formed on a side surface. Furthermore, a receiving groove 42 to receive the slide bar A70 to be movable in the axial direction is formed on the side surface of the sleeve A40. In this preferred embodiment, two the slide bars A70 are provided, and the engaging groove 41 and the receiving groove 42 are arranged alternately at an interval of substantially 90°. Furthermore, the edge at the clutch member 80 side in the sleeve A40 is notched in accordance with a circumferential direction extending portion 72 of the slide bar A70.

In the same way, the sleeve B45 is in a substantially cylindrical shape and a pair of engaging groove 46 extending in the axial direction is formed on its side. Furthermore, a receiving groove 47 to receive the slide bar B75 to be movable in the axial direction is formed on the side surface of the sleeve B45. In this preferred embodiment, two slide bars B75 are provided, and the engaging groove 46 and the receiving groove 47 are arranged alternately at an interval of substantially 90°. Furthermore, the edge of the clutch member 80 side in the sleeve B45 is notched in accordance with a circumferential direction extending portion 77 of the slide bar B75.

As shown in FIG. 1, each slide bar A70 is formed in a substantially T-shape, received in the receiving groove 42 of the sleeve A40, and provided with an axial direction extending portion 71 extending in an axial direction and a circumferential direction extending portion 72 extending in a circumferential direction at an edge of the clutch member 80 side of the axial direction extending portion 71. Each slide bar A70 moves in the axial direction toward the lever member 60 each time the sleeve A40 rotates relatively to the body A20 at a predetermined angle.

Similarly, as shown in FIG. 1, each slide bar B75 is formed in a substantially T-shape, received in the receiving groove 47 of the sleeve B45, and provided with an axial direction extending portion 76 extending in the axial direction and a circumferential direction extending portion 77 extending in the circumferential direction at the edge of the clutch member 80 side of the axial direction extending portion 76. Each slide bar B75 moves in an axial direction toward the lever member 60 each time the sleeve B45 rotates to the body B25 relatively at a predetermined angle.

As shown in FIG. 2, inside of the body A20 is formed in a step-like shape such that inner diameter is varied, and an end surface 73 opposite to the circumferential direction extending portion 72 in the axial direction extending portion 71 of the slide bar A70 slidably contacts to a step-like shaped sliding surface portion 22 of the body A20. A concave portion 23 is formed at a predetermined position of the sliding surface portion 22 extending in a circumferential direction. Here, since both edges in a circumferential direction of an end surface 73 and the concave portion 23 of each slide bar A70 are inclined, each slide bar A70 is smoothly inserted into and extracted from the concave portion 23 when they move relatively in a circumferential direction. Namely, the cylinder lock device 1 comprises a first cam mechanism having a sliding surface portion 22 formed on the body A20 and an end surface 73 as a sliding contact portion formed on the slide bar A70 slidably contacting with the sliding surface portion 22, wherein this cam mechanism moves the slide bar A70 in the axial direction when the sleeve A40 rotates to the body A20 relatively.

As shown in FIG. 2, the body B25 in cylindrical shape is arranged between the body A20 and the sleeve B45, the end surface 73 opposite to the circumferential direction extending portion 77 in the axial direction extending portion 76 of the slide bar B75 slidably contacts to a step-like shaped sliding surface portion 27 of the body B25. A concave portion 28 is formed at a predetermined position on the sliding surface portion 27 extending in a circumferential direction. Here, since both edges in a circumferential direction of an end surface 78 and the concave portion 28 of each slide bar B75 are inclined, each slide bar B75 is smoothly inserted into and extracted from the concave portion 28 when they move relatively in a circumferential direction. Namely, the cylinder lock device 1 comprises a second cam mechanism having a sliding surface portion 27 formed on the body B25 and an end surface 78 as a sliding contact portion formed on the slide bar B75 slidably contacting with the sliding surface portion 27, wherein this cam mechanism moves the slide bar B75 in the axial direction when the sleeve B45 rotates to the body B25 relatively.

FIG. 4A is an outline perspective view showing a clutch member 80. The clutch member 80 is in a substantially circular plate shape and a receiving hole 82 to receive an edge side of the rotor 30 is formed in its center. A cylindrical portion 83 extending toward the lever member 60 is formed in the clutch member 80 and a plurality of connecting portions 84 are formed by projection at the edge of the cylindrical portion 83. Each connecting portion 84 is inserted in the insert hole 61 formed on the lever member 60, so that the clutch member 80 is provided to be movable in the axial direction toward the lever member 60.

Each concave portion 81 is formed on an inner periphery of the receiving hole 82 of the key insert side in the clutch member 80. As a result, when each convex portion 36 of the rotor 30 has an angle not to fit to each concave portion 81, each convex portion 36 interferes with the surface of the key insert side to allow a relative rotation of the rotor 30 and the clutch member 80. Namely, a part other than the concave portion 81 in the clutch member 80 slidably contacts to the convex portion 36 in the state that the engagement of the clutch member 80 and the rotor 30 is released. As described above, a biasing force applied to the clutch member 80 from the coil spring 90 is received at the rotor 30 in the state that the engagement of the rotor 30 and the clutch member 80 is released.

Furthermore, a plurality of notches 85 for aligning the position with respect to the body A20 are formed in multiple positions at the outer periphery of the clutch member 80. Here, in this preferred embodiment, although the clutch member 80 is disengaged with the rotor 30 by moving in the axial direction, it may be configured to be disengaged with the lever member 60.

The coil spring 90 functions as a biasing member to bias the clutch member 80 to engage with the rotor 30. The coil spring 90 is wound around the cylindrical portion 83 and the connecting portion 84 of the clutch member 80, and sandwiched by a surface of the lever member 60 side of the clutch member 80 and a surface of the rotor 30 side of the lever member 60, so as to bias the slide bar A70, the slide bar B75, the sleeve A40 and the sleeve B45 toward the key insert side through the clutch member 80.

The lever member 60 is configured to be rotatable and facing to the key insert side in the rotor 30, and doors, trunk or the like of a vehicle is locked or unlocked by a rotation of the lever member 60. The doors may be locked or unlocked, for example, directly by connecting a wire for a door lock to the lever member 60, or indirectly by providing a switch to detect a rotation angle of the lever member 60.

A solenoid 200 has a function to make the body B25 rotatably movable or immovable with respect to the body A20. The solenoid 200 is installed to the position corresponding to a position of the body B25 on the outer periphery of the body A20 and makes the body B25 unrotatable with respect to the body A20 by a plunger 201 of the solenoid 200 which moves in a through hole 20*a* of the body A20 to engage with a lock hole 26 formed in the body B25. Furthermore, the solenoid 200 makes the body B25 rotatable with respect to the body A20 by the plunger which moves in a through hole of the first body and shunts to the solenoid side. As the solenoid 200, it is possible to use a solenoid which is operated by using a permanent magnet and a magnet coil, to move the plunger 201 in an inverse direction by changing a polarity of electrification. However, other actuators may be used, for example, and may be configured such that the lock member is moved by a combination of a motor and a gear to make the body B25 rotatably movable or immovable.

Operation of the Cylinder Lock Device in the Preferred Embodiment

In the preferred embodiment according to the present invention, an operation configuration for making the body B25 rotatably movable (ON) or immovable (OFF) with respect to the body A20 by operating the solenoid 200 is called as a valet system. A user such as an owner, a user, a driver, a crew or the like of a vehicle conducts ON/OFF operations of the solenoid 200 by a switch (not shown). The operation of the cylinder lock device 1 will be explained about the combination of the ON/OFF status of this valet system and respective key types (a regular key, a valet key, an unauthorized key) inserted in the key insert hole 31 of the rotor 30.

FIG. 5A is a cross sectional view (along A-A line in FIG. 1) showing the cylinder lock device in the state that the unauthorized key is inserted in the key insert hole of the cylinder lock device.

Figure 6:
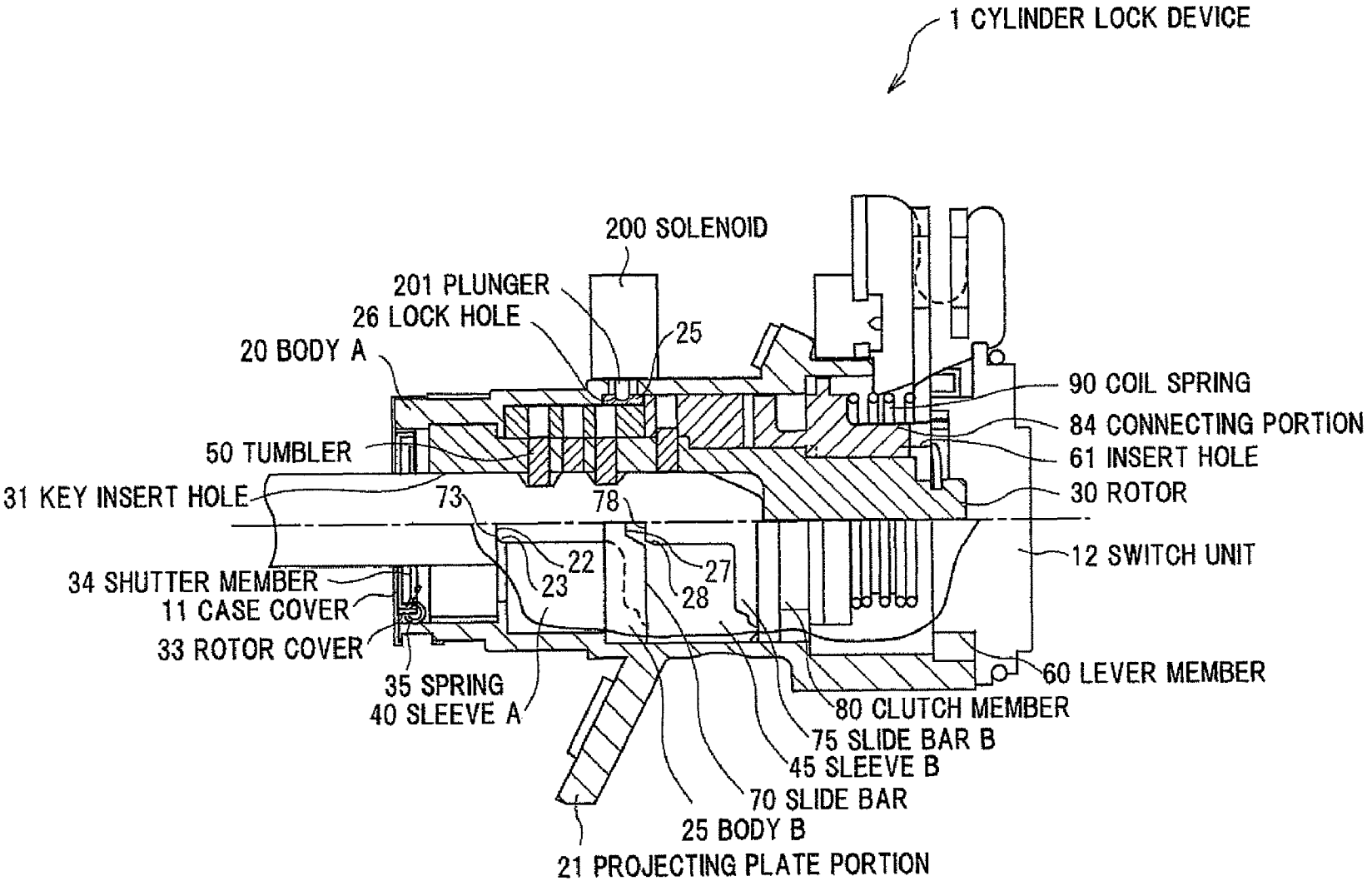
FIG. 6 is a cross sectional view (along A-A line in FIG. 1) of the cylinder lock device in the state that the valet key is inserted in the key insert hole of the cylinder lock device when a valet system is OFF.

FIG. 6 is a cross sectional view (along A-A line in FIG. 1) showing the cylinder lock device in the state that the valet key is inserted in the key insert hole of the cylinder lock device when the valet system is OFF.

Figure 7:
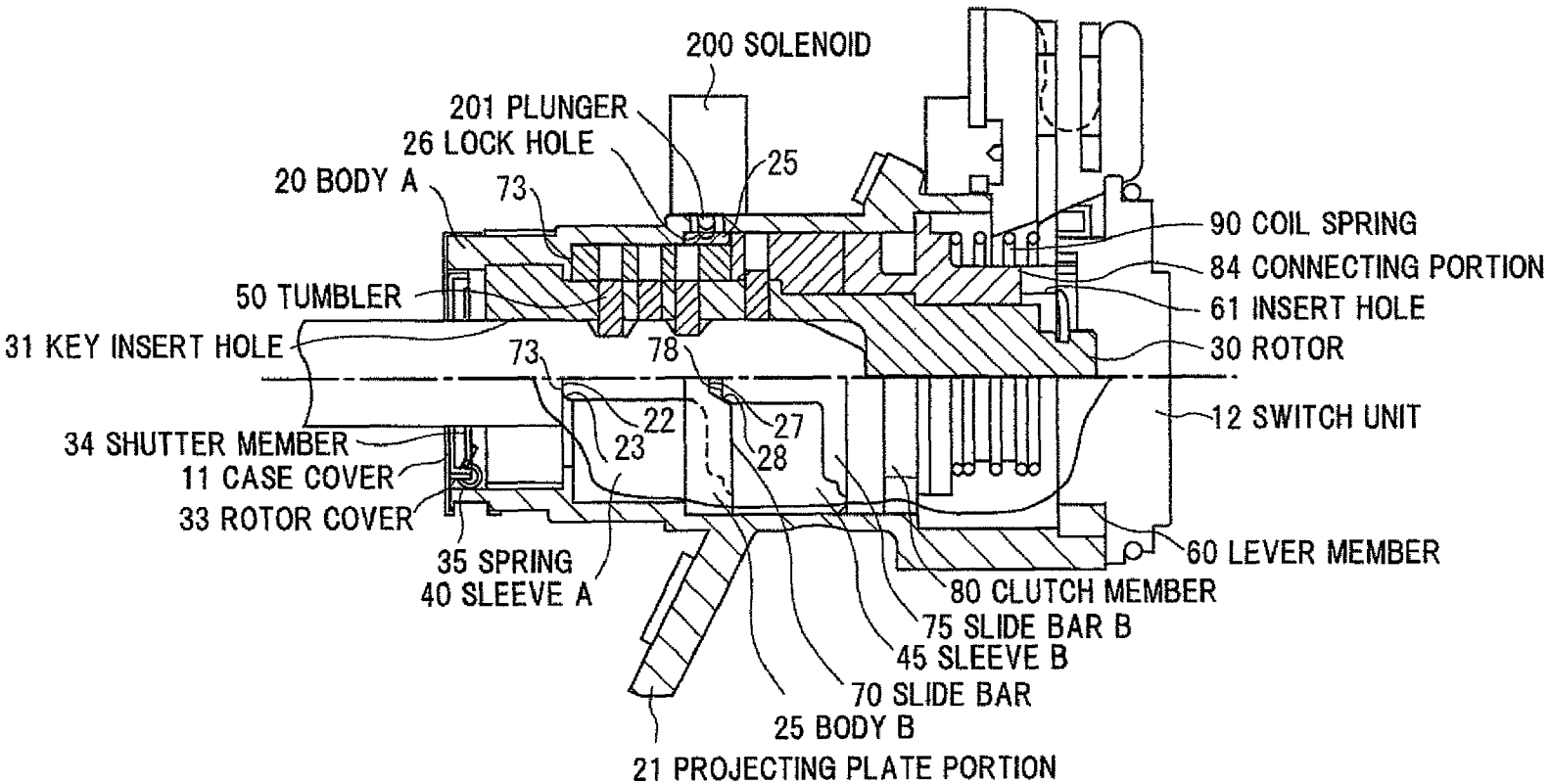

FIG. 7 is a cross sectional view (along A-A line in FIG. 1) showing the cylinder lock device in the state that the valet key is inserted in the key insert hole of the cylinder lock device when the valet system is ON.

(1) Operation of the cylinder lock device 1 in the state that the valet system is OFF.

(1-1) When the regular key is inserted in the key insert hole 31, all tumblers 50 are separated from the sleeve A40 and the sleeve B45 and the engagement therebetween is released, as a result, the rotor 30 and the sleeve A40, and, the rotor 30 and the sleeve B45 are relatively rotatable (see FIG. 2).

The rotor 30 is rotated by rotating the regular key, the sleeve A40 and the sleeve B45 are not rotated. Therefore, since the slide bar A70 and the slide bar B75 received in the sleeve A40 and B45 are not moved in the axial direction and the convex portion 36 of the rotor 30 and the concave portion 81 of the clutch member 80 remain fitted and engaged, the rotation of the rotor 30 is transmitted to the lever member 60 and the locking or unlocking operation is conducted.

(1-2) When the valet key is inserted in the insert hole 31, three tumblers 50 corresponding to the first groove region 401 in FIG. 3B is separated from the sleeve A40 and the engagement is released, as a result, the rotor 30 and the sleeve A40 are relatively rotatable. However, since the tumblers 50 corresponding to the third groove region 403 in FIG. 3B are not separated from the sleeve B45 and the engagement therebetween is not released, the rotor 30 and sleeve B45 are not relatively rotatable and they are rotated integrally (see FIG. 6).

The rotor 30 is rotated by rotating the valet key, while the sleeve A40 is not rotated. However, the sleeve B45 is rotated with the rotor 30 integrally. Here, in the state that the valet system is OFF, since the body B25 is immovable with respect to the body A20, the slide bar B75 received in the sleeve B45 receives a force in the axial direction by the inclination in the circumferential direction of an edge surface 78 and the concave portion 28 of the body B25 by the rotation of the sleeve B45, each slide bar B75 is smoothly inserted to and extracted from the concave portion 28 and moves toward the clutch member 80.

As a result, each slide bar B75 pushes the clutch member 80 toward the lever member 60, so that the engagement between the convex portion 36 of the rotor 30 and the concave portion 81 of the clutch member 80 is released. As a result, the rotation of the rotor 30 is not transmitted to the lever member 60 and the locking or unlocking operation is not conducted. Namely, the valet key is not provided with the same function as that of the regular key. However, even though the key groove shape of the valet key is partially different from that of the regular key, the shape of other parts is identical to each other. Therefore, it is possible to conduct the same function as that of the regular key by the identical parts.

Figure 5:
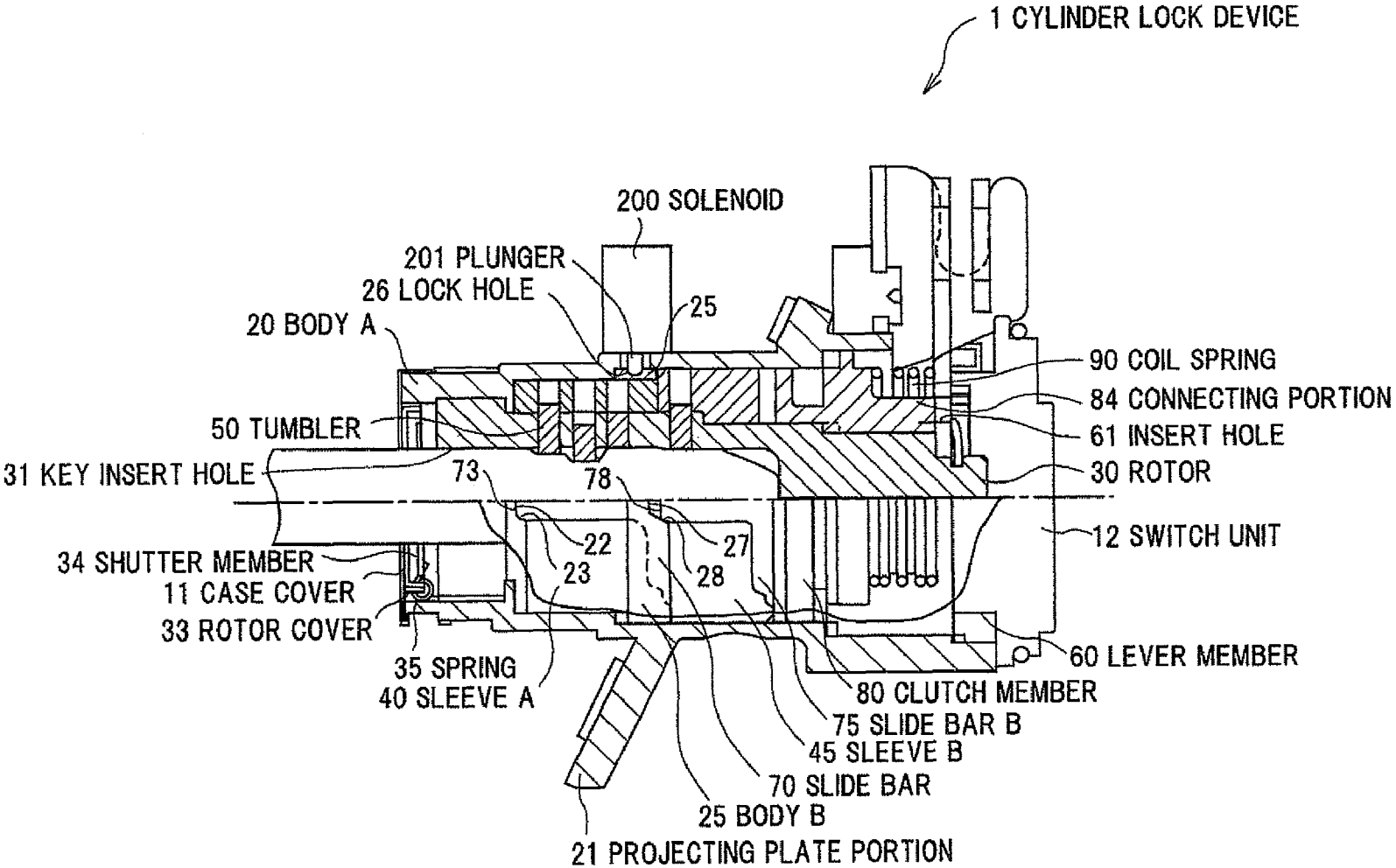
FIG. 5 is a cross sectional view (along A-A line in FIG. 1) of the cylinder lock device in the state that an unauthorized key is inserted in the key insert hole of the cylinder lock device.

(1-3) When the unauthorized key is inserted in the key insert hole 31, since all tumblers 50 are not separated from the sleeve A40 and the sleeve B45 and the engagement therebetween is not released, the rotor 30 and the sleeve A40, and, the rotor 30 and the sleeve B45 are rotated integrally, respectively (see FIG. 5).

The slide bar A70 received in the sleeve A40 receives a force in the axial direction by the inclination in the circumferential direction of the edge surface 73 and the concave portion 23 of the body A20 by the rotation of the sleeve A40, each slide bar A70 is smoothly inserted to and extracted from the concave portion 23 and moves toward the sleeve B45.

Furthermore, the slide bar B75 received in the sleeve B45 receives a force in the axial direction by the incline in circumferential direction of its edge surface 78 and the concave portion 28 of the body B25 by the rotation of the sleeve B45, each slide bar B75 are inserted and extracted to the concave portion 28 smoothly and moves toward the clutch member 80.

The clutch member 80 is pushed toward the lever member 60 by movement of the slide bar A70 and the slide bar B75, the engagement between the convex portion 36 of the rotor 30 and the concave portion 81 of the clutch member 80 is released. As a result, the rotation of the rotor 30 is not transmitted to the lever member 60 and the locking or unlocking operation is not conducted. Namely, the valet key is not provided with the same function as that of the regular key. Furthermore, since the key grooves of the unauthorized key are different in all shapes from those of the regular key, it is not possible to conduct the same functions as those of the regular key.

(1) The operation of the cylinder lock device 1 in the state that the valet system is ON.

(2-1) When the regular key is inserted in the key insert hole 31 and rotated, the operation thereof is same as that of the cylinder lock device 1 in the state that the valet system is ON.

(2-2) When the valet key is inserted in the insert hole 31, the three tumblers 50 corresponding to the first groove region 401 in FIG. 3B are separated from the sleeve A40 and the engagement therebetween is released. As a result, the rotor 30 and the sleeve A40 are relatively rotatable. However, since the tumblers 50 corresponding to the third groove region 403 in FIG. 3B is not separated from the sleeve B45 and the engagement therebetween is not released, the rotor 30 and the sleeve B45 are not relatively rotatable and they rotate integrally (see FIG. 7).

The rotor 30 is rotated by rotating the valet key, while the sleeve A40 is not rotated. However, the sleeve B45 is rotated together with the rotor 30 integrally. Here, since the body B25 is rotatably movable to the body A20 in the state that the valet system is ON, the sleeve B45 and the body B25 are rotated integrally with the edge surface 78 of the slide bar B75, and the concave portion 28 of the body B25 is still engaged. Therefore, the slide bar B75 is not moved toward the clutch member 80.

Therefore, since the slide bar A70 and the slide bar B75 received in the sleeve A40 and the sleeve B45 are moved in the axial direction, and the convex portion 36 of the rotor 30 and the concave portion 81 of the clutch member 80 remain fitted and engaged, the rotation of the rotor 30 is transmitted to the lever member 60 and the locking or unlocking operation is conducted.

Namely, the valet key is provided with the same function as that of the regular key. However, even though the shape of the key groove of the valet key is partially identical to that of the regular key, the shape of other parts of the valet key does not coincide with those of the regular key, so that it is possible to suppress the same function as the regular key by providing the different parts.

(2-3) When the unauthorized key is inserted in the key insert hole 31, since all tumblers 50 are not separated from the sleeve A40 and the sleeve B45 and the engagement therebetween is not released, the rotor 30 and the sleeve A40, and, the rotor 30 and the sleeve B45 are rotated integrally respectively (see FIG. 5).

The slide bar A70 received in the sleeve A40 receives a force in the axial direction by the inclination in the circumferential direction of the edge surface 73 and the concave portion 23 of the body A20 by the rotation of the sleeve A40, each slide bar A70 is smoothly inserted to and extracted from the concave portion 23, and is moved toward the sleeve B45.

Meanwhile, in the state that the valet system is ON, since the body B25 is rotatably movable with respect to the body A20, the sleeve B45 and the body B25 are rotated integrally with the edge surface 78 of the slide bar B75 and the concave portion 28 of the body B25 is still engaged. Therefore, the slide bar B75 is not moved toward the clutch member 80.

However, since the slide bar A70 is moved toward the sleeve B45 by a rotation of the sleeve A40, the clutch member 80 is pushed toward the lever member 60 through the sleeve B45, the engagement between the convex portion 36 of the rotor 30 and the concave portion 81 of the clutch member 80 is released. As a result, the rotation of the rotor 30 is not transmitted to the lever member 60 and the locking or unlocking operation is not conducted. Namely, the unauthorized key is not provided with the same function as that of the valet key or the regular key. Furthermore, since the key grooves of the unauthorized key are different in all shapes from those of the regular key, it is not possible to conduct the same functions as those of the regular key.

Effect of the Cylinder Lock Device in the First Preferred Embodiment (1) According to the cylinder lock device in the first preferred embodiment, the valet system can be turned ON or OFF by the user's purpose, it is possible to store the valet key in a glove box of the vehicle, and the like. Generally, the valet key is not used improperly if the valet system is turned OFF. Therefore, there is an effect that the user does not need to carry an extra key (a valet key).

(2) Although it is possible to lock, unlock and start up the engine by turning the valet system ON or OF, it is also possible to unable unlocking of a trunk or a glove box in the vehicle, and to change the function of the regular key and the valet key.

(3) It is possible to realize the high security cylinder lock device by simply adding few parts to the conventional cylinder lock device.

Structure of the Cylinder Lock Device in a Second Preferred Embodiment

The cylinder lock device in the second preferred embodiment according to the present invention is similar to that in the first preferred embodiment in that ID check is conducted by an immobilizer in a motion control of the valet system. In the first preferred embodiment, the user conducts the ON/OFF operation of the solenoid 200 by a switch etc., however, in the second preferred embodiment, the ID is checked by the immobilizer to improve the security.

Figure 8:
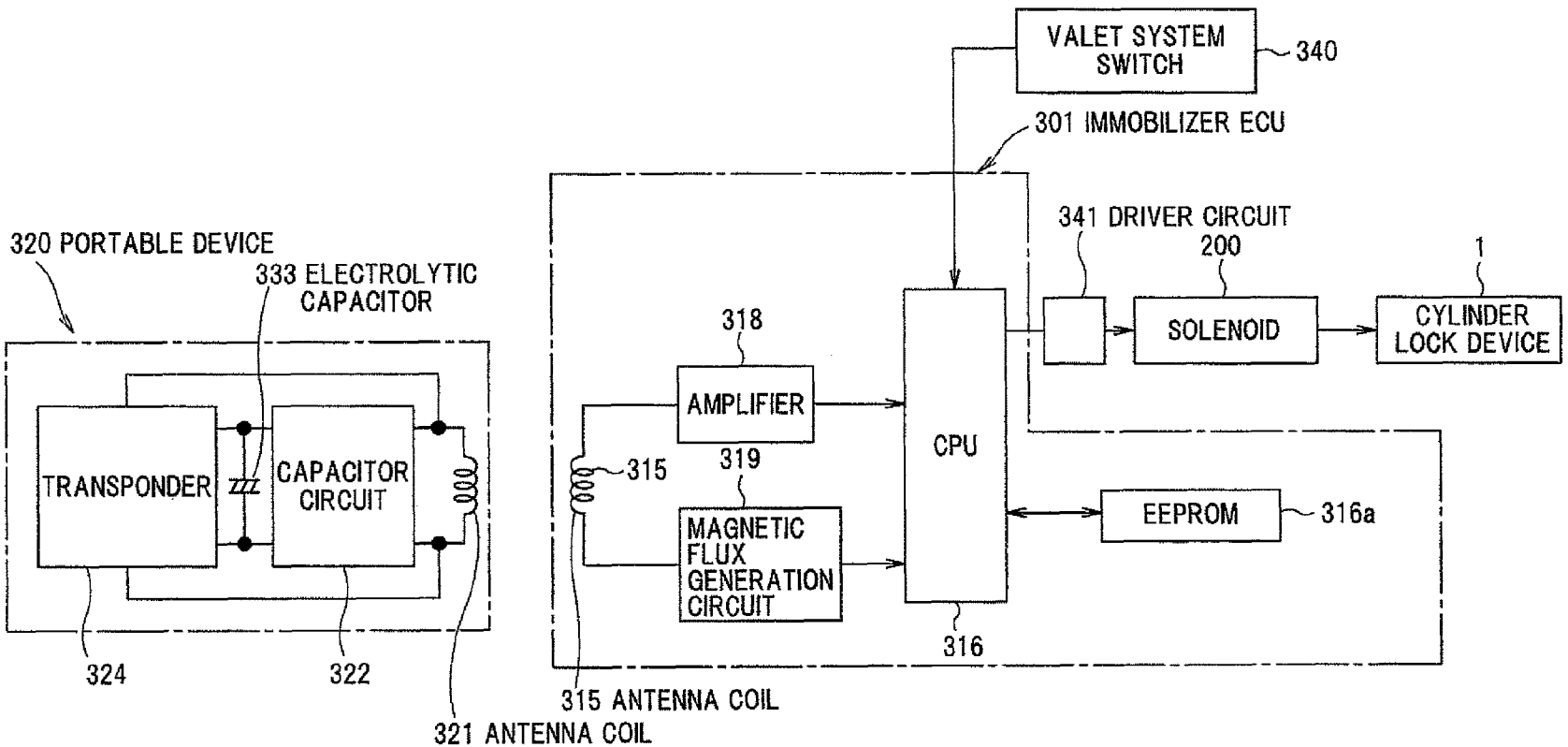
FIG. 8 is a block diagram of the valet system for verifying an ID by an immobilizer.

FIG. 8 is a block diagram of the valet system for checking the ID by the immobilizer. In the cylinder lock device in the first preferred embodiment, the ID is checked by a mobile device (the immobilizer) carried by the user, and it is possible to conduct the ON/OFF operation of the solenoid 200 when the ID is verified. Other mechanism in the second preferred embodiment is same as that in the first preferred embodiment.

The immobilizer is a system in which an IC chip called as a transponder 324 is incorporated in a portable device 320, the same ID code (identification code) is stored in the transponder 324 and an immobilizer ECU (Electric Control Unit) 301 in the vehicle, the ID code is transmitted from the portable device 320 when approached to the vehicle side immobilizer 330 and it is possible to start up the engine or to operate an in-vehicle equipment when the portable device 320 coincides with the ID code of the immobilizer ECU 301.

The portable device 320 comprises an antenna coil 321, a capacitor circuit 322 for obtaining a direct voltage by rectifying an electromotive force induced by the antenna coil 321, an electrolytic capacitor 323 for storing an output power of the capacitor circuit 322, and the transponder 324 operated by an electrical power stored in the electrolytic capacitor 323 as a power source.

The transponder 324 is configured to previously store the ID code of the portable device 320 and to transmit the ID code by using an electric power as a power source when the electric power greater than a predetermined value is stored in the electrolytic capacitor 323 by the capacitor circuit 322.

The immobilizer ECU 301 comprises an antenna coil 315, a CPU 316, an EEPROM (Electronically Erasable and Programmable Read Only Memory) 316*a* for storing the ID code of the vehicle side, an amplifier 318 for amplifying a signal (ID code) received at the antenna coil 315, and a magnetic flux generation circuit 319 for outputting a power signal to the antenna coil 315.

The solenoid 200 is connected to the CPU 316 through a driver circuit 341. Furthermore, a valet system switch 340 is connected through an interface circuit (not shown).

Motion Control of the Valet System

When the portable device 320 is approached to the antenna coil 315 of the immobilizer ECU 301, the power signal and a request signal are transmitted from the antenna coil 315 to the portable device 320. In the portable device 320, the power signal received by the antenna coil 321 is rectified by the capacitor circuit 322 to provide the direct voltage, the transponder 324 is operated by storing this voltage to the electrolytic capacitor 323 as power source and the request signal overlapped with the power signal is detected.

The transponder 324 converting the ID code read out from the EEPROM (not shown) in the portable device 320 into an electric wave with a predetermined frequency to transmit the electric wave from the antenna coil 321, when the request signal transmitted from the antenna coil 321 corresponds to the portable device 320.

The ID code read from the portable device 320 is received through the antenna coil 315 of the immobilizer ECU 301. The CPU 316 demodulates the received signal to generate the ID code and compares the demodulated ID code with the ID code stored in the EEPROM 316*a*.

When the valet system switch is turned ON in the state that both ID codes matches with each other and an ID authentication is approved, the solenoid 200 is activated through the driver circuit 341, thereby making the body B25 rotatably movable with respect to the body A20 (the valet system is ON) by moving the plunger 201 of the solenoid 200.

Effect of Cylinder Lock Device According to the Second Preferred Embodiment (1) According to the cylinder lock device in the second preferred embodiment, since the ID authentication by the immobilizer is required for the operation of the valet system, it is possible to provide the cylinder lock device with the security higher than that of the first preferred embodiment.

(2) In vehicles of recent years, a portable device incorporating the immobilizer is widely used, and it is possible to realize a cylinder lock device with extremely high security by simply adding few parts onto the conventional cylinder lock device while reducing the cost.

Although the invention has been described with respect to the specific embodiments for complete and clear disclosure, the appended claims are not to be therefore limited but are to be construed as embodying all modifications and alternative constructions that may occur to one skilled in the art which fairly fall within the basic teaching herein set forth.

What is claimed is:

1. A cylinder lock device comprising:

a first body in cylindrical shape;

a rotor arranged to be rotatable inside the first body including a key insert hole to which a key is inserted, the key insert hole being formed to extend in an axial direction;

a first sleeve arranged to be rotatable between the first body and the rotor;

a second sleeve arranged to be rotatable between the first body and the rotor, and disposed more distant than the key insert hole;

a tumbler provided in the rotor to be movable in a radial direction to engage with the first sleeve or the second sleeve when biased to an outer radial direction and disengage with the first sleeve or the second sleeve when a regular key is inserted into the key insert hole;

a lever member arranged to be rotatable and facing to a key insert hole side in the rotor, for locking or unlocking a vehicle;

a first slide member arranged between the first sleeve and the first body, for moving in an axial direction toward the lever member each time the first sleeve rotates relatively to the first body at a predetermined angle;

a second body in a cylindrical shape arranged between the first and second sleeve, a lock part for making the second body rotatably movable or immovable with respect to the first body;

a second slide member arranged between the second sleeve and the second body, the second slide member moving in the axial direction toward the lever member each time the second sleeve rotates relatively to the second body at a predetermined angle;

a clutch member arranged between the rotor and the lever member to be movable in the axial direction in the lever member, and allowed to engage or disengage with the rotor; and a biasing member to bias the clutch member toward the rotor to be engaged with the rotor.

2. The cylinder lock device according to claim 1, wherein the clutch member transmits a rotation of the rotor to the lever member when the key is a regular key in a state that the second body is made unrotatable by the lock part, and when the key is the regular key or a valet key in the state that the second body is made rotatable by the lock part.

3. The cylinder lock device according to claim 2, wherein the valet key is provided with a different shape from the regular key in a part of a key tooth.

4. The cylinder lock device according to claim 3, wherein each of the regular key and the valet key is provided with a key tooth shape corresponding to a first region, a second region or a third region of the tumbler, and the key tooth shape of the valet key is same as that of the regular key in the first region but the third region of the valet key is different from the second region of the regular key.

5. The cylinder lock device according to claim 4, wherein the first sleeve is provided with an engaging groove to be engaged with an edge of the outer radial direction of the tumblers corresponding to the first region.

6. The cylinder lock device according to claim 1, wherein the second sleeve is provided with an engaging groove engaged with an edge of the outer radial direction of the one tumbler corresponding to the second or third region is formed in the second sleeve.

7. The cylinder lock device according to claim 5 or 6, wherein the first sleeve or the second sleeve rotates integrally with the rotor by engaging with each tumbler biased toward the outer radial direction.

8. The cylinder lock device according to claim 1, wherein the first sleeve is in a substantially cylindrical shape, and provided with a pair of engaging grooves extending to the axial direction at a side thereof and a receiving groove for receiving the first slide member to be movable in the axial direction at the side thereof.

9. The cylinder lock device according to claim 8, wherein the first slide member is formed in a substantially T-shape, received in the receiving groove of the first sleeve, and provided with an axial direction extending portion extending in the axial direction, and a circumferential direction extending portion extending in a circumferential direction at an edge of a clutch member side of the axial direction extending portion.

10. The cylinder lock device according to claim 1, wherein the second sleeve is in a substantially cylindrical shape, and provided with a pair of engaging grooves extending to the axial direction at a side thereof, and a receiving groove for receiving the second slide member to be movable in the axial direction at a side thereof.

11. The cylinder lock device according to claim 10, wherein the second slide member is formed in a substantially T-shape, received in the receiving groove of the second sleeve, and has an axial direction extending portion extending in an axial direction and a circumferential direction extending portion extending in a circumferential direction at an edge of a clutch member side of the axial direction extending portion.

12. The cylinder lock device according to claim 1, wherein the first body is formed in a step-like shape so that an inner diameter varies inside, and an end surface opposite to the circumferential direction extending portion in the axial direction extending portion of the first slide member slidably contacts to a step-like shaped sliding surface portion of the first body.

13. The cylinder lock device according to claim 12, wherein the first body has a concave portion formed at a predetermined position on the sliding surface portion extending in the circumferential direction and both edges in the circumferential direction of the concave portion are inclined.

14. The cylinder lock device according to claim 12, wherein both edges in the circumferential direction of the end surface of the first slide member are inclined.

15. The cylinder lock device according to claim 1, wherein the second body has a step-like shaped sliding surface portion which slidably contacts to an end surface opposite to the circumferential direction extending portion in the axial direction extending portion of the second slide member.

16. The cylinder lock device according to claim 15, wherein the second body has a concave portion formed at a predetermined position on the sliding surface portion extending in the circumferential direction and both edges in the circumferential direction of the concave portion are inclined.

17. The cylinder lock device according to claim 15, wherein both edges in the circumferential direction of the end surface of the second slide member are inclined.

18. The cylinder lock device according to claim 1, wherein the biasing member is a coil spring.

19. The cylinder lock device according to claim 1, wherein the lock part is a solenoid installed in a periphery of the first body corresponding to a position of the second body.

20. The cylinder lock device according to claim 19, wherein the solenoid makes the second body unrotatable with respect to the first body by a plunger of the solenoid which moves in a through hole of the first body and engages with a lock hole formed in the second body, and makes the second body rotatable with respect to the first body by the plunger which moves in the through hole of the first body and shunts toward the solenoid.

* * * * *